United States Patent [19]

Pignatti et al.

[11] 3,974,788

[45] Aug. 17, 1976

[54] ATTACHMENT FOR SEWING BORDERS AND COLLARS ON KNITTED GARMENTS

[76] Inventors: Ugo Pignatti, Via Guido Fassi 12; Giuliano Scacchetti, Via L. Spallanzani 16, both of 41012 Carpi, Italy

[22] Filed: June 18, 1974

[21] Appl. No.: 480,502

[30] Foreign Application Priority Data

July 27, 1973 Italy ..... 40074/73

[52] U.S. Cl. ..... 112/140; 112/141

[51] Int. Cl.[2] ..... D05B 35/04

[58] Field of Search ..... 112/140, 141, 142, 143, 112/147, 152, 136

[56] References Cited

UNITED STATES PATENTS

| | | | |
|---|---|---|---|
| 880,678 | 3/1908 | Martin | 112/141 |
| 922,440 | 5/1909 | Parsons | 122/141 |
| 1,681,949 | 8/1928 | Morvay | 112/141 |
| 2,173,509 | 9/1939 | Swanson | 112/141 |
| 3,736,892 | 6/1973 | Gray | 112/141 |

*Primary Examiner*—H. Hampton Hunter
*Attorney, Agent, or Firm*—Michael J. Striker

[57] ABSTRACT

A sewing arrangement is mounted on chain-stitch sewing machines to permit efficient sewing of borders and collars on knitted garments.

10 Claims, 8 Drawing Figures

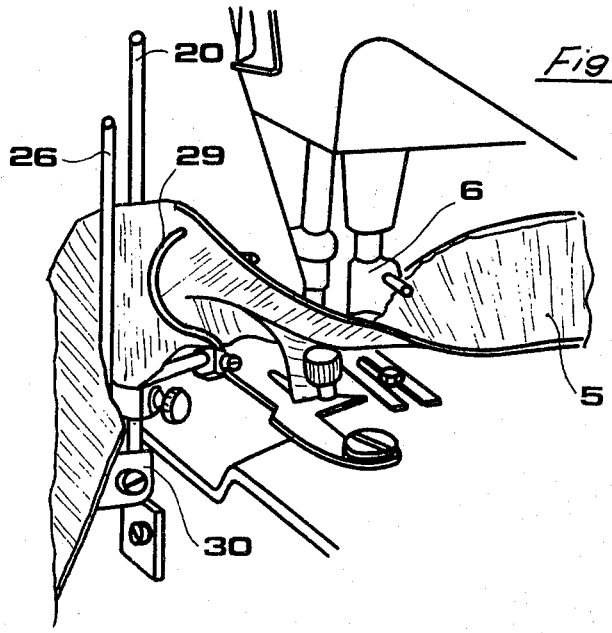
Fig. 6
Fig. 7
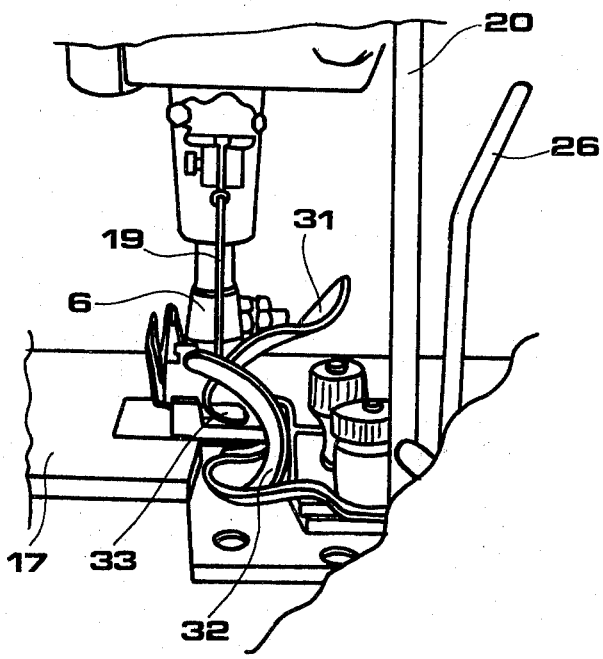
Fig. 8
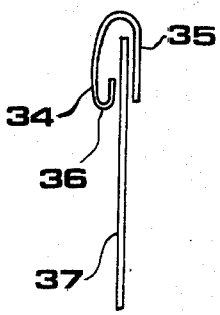

ATTACHMENT FOR SEWING BORDERS AND COLLARS ON KNITTED GARMENTS

This invention relates to a sewing arrangement which is mounted on chain-stitch sewing machines to permit the quick sewing of finishing elements such as borders and collars, on knitted goods.

As is well known, knitwears are generally provided with equally knitted borders at the collar opening and at the sleeve opening.

In a closely analogous manner, knitted jackets are provided about the collars and/or at the ends of the sleeves with collars and feints, which may be either singly sewed, namely by being turned out, or doubly turned over prior to being sewed.

The application of such finishing elements requires at present the use of particular machines called linking machines, which are relatively expensive and complicated.

Also the use of special chain-stitch machines of the single or double type, besides giving a poor quality product, requires the preparation of the borders on the knitted item to be handled with turns of tubular stitching in order to crease the fold at the desired height.

The above-outlined functional and economical inconveniences are obviated by the mechanical arrangement comprising a plurality of attachments according to the present invention. Said attachments, when fitted to an ordinary sewing machine making the chain-stitch, permit the sewing machine to sew borders or collars on knitwears, without having to initially prepare them.

Furthermore, the arrangement of this invention consists of a series of shaped elements, positioned on the sewing machine so as to impart to the borders or the collars a folded configuration prior to its or their coming under the sewing needle together with the knitted item to be finished.

The arrangement of this invention is further provided with a pivotable element, being supplied upstream of the sewing needle of the sewing machine and acting to functionally retard the border or collar so that it might remain constantly properly oriented, when a border is involved; thereby avoiding the danger that the border might position itself in a helicoidal manner and not be properly fed under the sewing needle.

In practice, the arrangement according to the present invention is constituted in one of its general embodiment forms of three structures of sheared sheet metal material, folded, bent, curved and so shaped as to shape the finishing element, i.e. the border or collar, according to a U-shaped cross section.

One of said structures may show further a side rib, being suitably bent, permitting to impart a double curvature in longitudinal direction to one of the peripheral portions of the border.

The arrangement further comprises an arcuate structure, which by cooperating with a series of suitably, arranged rods, serves as a pre-conveying and brake means for the feed of the border or collar and holds them constantly stretched so as to avoid their helical bending in the portion comprised between the presser foot of the sewing machine and the brake itself.

These and further characteristic features of a functional and constructional nature of the arrangement applicable to chain-stitch sewing machines according to the present invention could be better understood from the following detailed description, taken in conjunction with the various figures on the accompanying drawings, in which:

FIG. 6 represents a schematic perspective side view of the work-surface shown in FIG. 5 during operation of the sewing machine and with the collar inserted therein;

FIG. 7 shows a schematic perspective side view of the work-surface given in the preceding FIGS. 5 and 6, where the shapes of the structures have been suitably modified in order to ensure the double curvature of one of the peripheral portions of the border; and FIG. 8 illustrates schematically and by way of illustration the curvature being taken on by a border, applied to a knitted item.

Figure 1:
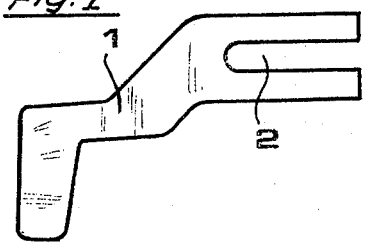
FIG. 1 represents a schematic top view of one of the three structures, constituting the arrangement according to the present invention and being placed in proximity of the presser foot of the sewing machine.
Figure 3:
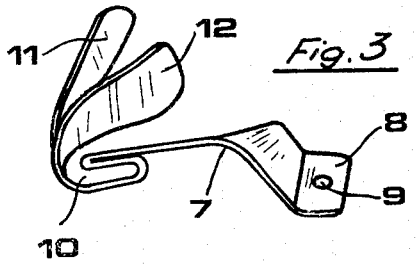
FIG. 3 shows a schematic perspective view of another of the three structures comprising the arrangement and performing the function of imparting to the collar the desired curvature.
Figure 2:
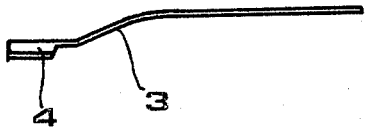
FIG. 2 shows a schematic side view of the structure illustrated in FIG. 1.
Figure 4:
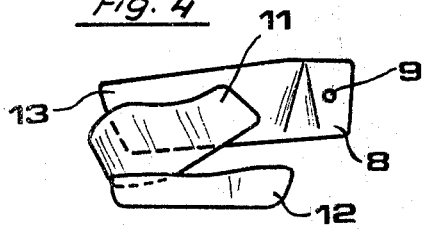
FIG. 4 represents a schematic top view of the structure given in FIG. 3.

Referring now particularly to the numerals shown in the various figures on the accompanying drawings, the arrangement of this invention, applicable to chain-stitch sewing machines, consists of a metal guiding structure or guiding means, preferably formed of sheet material, provided at one end with a split or bifurcated end 2, and adapted to ensure its fastening by means of a screw to the work-surface 17 of the sewing machine adjacent the presser foot 6.

Said guiding means 1 comprises end in its opposite the split end 2, a fold or bend 3 and a curved end 4, disposed perpendicularly of the structure 1. The fold 3 and the curved end 4 have the function of permitting and guiding collar 5 to fit underneath the presser foot 6 of the sewing machine.

The arrangement according to the present invention further includes a metal shaping structure or shaping means 7, also formed of sheet metal material and having a flat end 8, in which there is drilled a hole 9 for fastening the shaping means 7 to the work-surface 17 of the sewing machine. Said shaping means 7, which is bent to nearly a Z-shaped configuration with rounded off corners shows in the portion opposite the flat portion 8, a recess delimiting a cavity 10 through which passes the already curved collar 5. The end of said shaping means 7 is vertically cut into two arms 11 and 12, which are curved in opposite direction and offset relative to each other, so as to fold inwardly the borders of the collar passing therebetween. The shaping means 7 is further provided with a point or edge 13, against which the collar slides; the collar being already folded up and about to slide onto the curved end 4 of the guiding means 1 to reach underneath the presser foot 6 of the sewing machine.

The arrangement further comprises, when it is used for the application of collars, a positioning plate means or metal plate 14, formed of sheet metal material, having one end fastened by means of a screw 15 to the work-surface surface 17 of the sewing machine, on the side opposite that to which the shaping means 7 is fixedly secured.

Said positioning plate means 14 is provided laterally with a folded up tongue 16, resting against the edge of the work-surface 17 so as to contact the side 22.

Said positioning plate means 14 is provided with a curved arm 18 at the end opposite the fastened end, which curved arm 18, by cooperating with the point 13 of the shaping means 7 maintains in line the fold of the collar 5 — on which the sewing through the needle 19 will be performed — and guides the edge of the jacket on which the collar itself is being sewn.

Said positioning plate means 14 is disposed on the work-surface 17 of the sewing machine so that its curved arm 18 lies between the point 13 of the guiding means 7 and the curved end 4 of the structure 1.

The arrangement according to this invention includes a pivotable pre-shaping means or pre-shaping structure consisting of a rod 20, hinged to a small bracket 21, fastened on the side 22 of the sewing machine.

Over said rod 20, there may slide and be positioned by means of a proper screw 23, a collar 24 provided with a rod 25.

With the latter, there is integral a rod 26, perpendicular thereto.

At one end of the same rod 25, there is further provided on adjustably mounted collar 27, which may be clamped to the desired position via a screw 28.

To said collar 27 there is fixedly secured a suitably arcuate rod 29, performing the task of pre-shaping the curvature of the collar 5.

Figure 5:
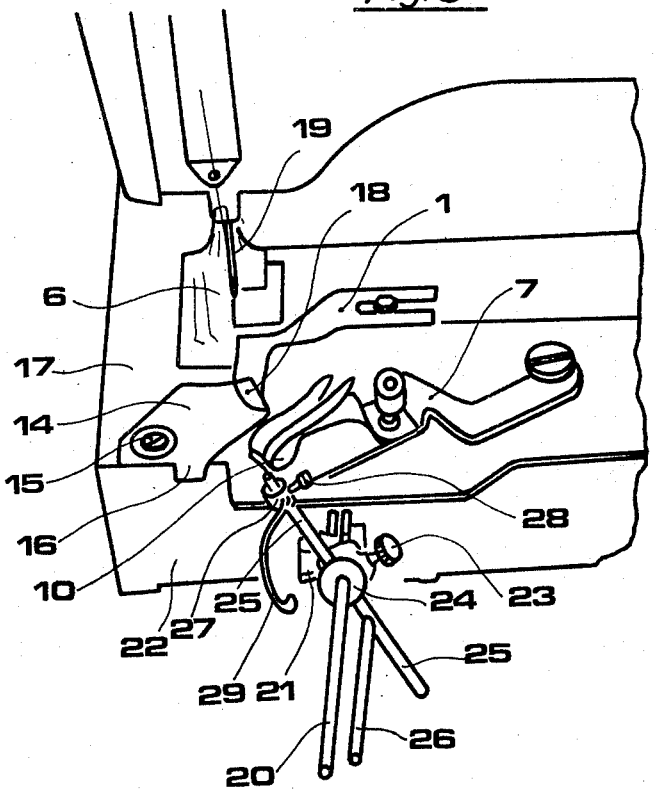
FIG. 5 shows a schematic perspective view of the work-surface of a sewing machine to which the structures comprising the arrangement of this invention have been mounted.

It should be stressed here that the rod 20 may be overturned or pivoted downwardly (FIG. 5) until it assumes a horizontal setting so as to ensure the introduction by hand of the initial portion of the collar 5 into the cavity 10 of the shaping means 7. Subsequently, the rod 20 may be pivoted in the vertical direction (see FIG. 6), so as to cooperate with the rod 26 and the rod 29 to functionally retain the collar 5.

The hinge, connecting the rod 20 to the small bracket 21, is adapted to be frictionally locking so that the rod itself, once positioned in a vertical direction, maintains its position.

The stability is ensured further by a plate 30, integral with the rod 20 itself, which also serves as an end limit means.

Should one operate on a border, the guiding end shaping means 1 and 7 assume preferably, the configuration of the parts 31 and 32 shown in FIG. 7.

In particular, the part 31 is fastened to the presser foot 6 and hence accompanies all its movements, permitting the passage under it both of the border of the knitted item and the border to be applied thereto.

The same part 31 is further provided with a properly curved end 33, forcing the edge 34 of the border 35 to assume an albow-like loop 36. It should be stated finally that by the aforementioned modified attachment the border 35 is applied on the right side of the knitted item 37.

The metal structures comprising the arrangement of this embodiment are nearly in-line positioned so as to form a forced passageway through which the border has to pass to reach underneath the needle 19. In particular, the first two elements 31 and 32 have the task of folding the border on the knitted item, inasmuch as said border, by sliding over the curved surfaces of said elements, is forced to take on a C-shaped folding. From the foregoing specification and from perusal of the various figures on the accompanying drawings, one may easily see the great functional character and practical application characterizing the arrangement according to this invention.

In the practical accomplishment of the attachment of this invention, several changes and modifications may be introduced without departing from the very spirit of this invention.

It is understood that any such changes and modifications should be deemed as falling within the protective scope of this invention.

What we claim is:

1. An arrangement, applicable to sewing machines for sewing borders and collars or knitted garments at the collar's and sleeves' openings, comprising a metal pre-shaping structure including a first movable rod hinged by a bracket to a side of the sewing machine and over which first rod a collar slide may travel, said collar slide being provided with a second rod which is provided at one end with a third rod extending perpendicular with respect to said second rod and parallel to said first rod, and at the other end with an arcuate rod for starting the curvature of the collar, said arcuate rod being movably fastened to said second rod; a metal shaping structure downstream of said metal pre-shaping structure terminating with a flat portion which is provided with a hole and curved into nearly a Z-shaped configuration with rounded-off corners, said shaping structure having in a portion opposite said flat portion a recess delimiting a cavity through which the curved collar passes and having its end shaped as two vertically extending limbs, each curved in a direction opposite to the other end offset relative thereto so as to internally fold the edges of the collar passing therebetween, said metal shaping structure further having a point against which the collar slides; and a metal guiding structure downstream of said metal shaping structure formed of thin sheet metal terminating with a split end and provided with a fold and a curved end perpendicular to the structure itself, the collar sliding over the curved end after sliding against the point for easing the introduction of the collar underneath the presser foot of the sewing machine.

2. Arrangement as defined in claim 1, wherein the hinge connecting the first rod to the bracket frictionally supports said first rod on the bracket, the stability of said first rod being ensured by a plate which is integral with said first rod and serving as an end limit means.

3. Arrangement as defined in claim 2; and further comprising a metal plate fastened to the work surface of the sewing machine on a side opposite that on which there is fastened the shaping structure and provided at its end with a curved limb disposed between the point of the shaping structure and the curved end of the guiding structure.

4. Arrangement as defined in claim 3, wherein the metal plate is provided laterally with a folded-up tongue which rests against the edge of the work surface of the sewing machine.

5. Arrangement as defined in claim 4, wherein the metal guiding structure for facilitating the introduction of the collar underneath the presser foot is secured to the presser foot itself and is provided with a proper curvature for guiding an elbow-like loop of a border edge.

6. In an arrangement for sewing finishing elements, particularly borders, collars and the like, on garments, a combination comprising a sewing machine having a work surface defining a sewing path and a stitching station at the end of said path; pre-shaping means for pre-shaping the curvature of the finishing element to be sewn on a garment, said pre-shaping means including a support pivotably mounted on said work surface so as to move from a first position in which said support receives said finishing element to a second working position in which the finishing element is supported in requisite orientation, and including means for adjusting the position of said support relative to said work surface so as to shape the finishing element to an initial curvature; shaping means located downstream of said pre-shaping means in said path on said work surface and having contoured arms and a recess operative for shaping the finishing element into the desired final curvature, said shaping means having an edge; and guiding means located downstream of said shaping means on said work surface and having a curved portion located adjacent and forming a gap with said edge for slidably guiding the shaped finishing element through said gap and in said path towards said stitching station where the finishing element is sewn to the garment.

7. A combination as defined in claim 6; and further comprising friction-locking hinge means having a first hinge portion mounted on said sewing machine and a cooperating hinge portion connected to said support for maintaining said pre-shaping means in said second working position.

8. A combination as defined in claim 6; and further comprising limiting means intergral with said support for limiting the pivotal movement of said pre-shaping means.

9. A combination as defined in claim 6, wherein said adjusting means comprises a collar member slidably mounted on said support and set-screw means for locking the position of said collar member.

10. A combination as defined in claim 6; and further comprising positioning plate means mounted in said path intermediate said shaping means and said guiding means for guiding the edge of a garment towards said stitching station.

* * * * *